US006104271A

United States Patent [19]

Barrett

[11] Patent Number: 6,104,271

[45] Date of Patent: Aug. 15, 2000

[54] COMPOSITE RARE EARTH MAGNET AND METHOD FOR SEPARATING FERROUS MATERIAL FROM NON-FERROUS MATERIAL

[75] Inventor: William T. Barrett, Greeneville, Tenn.

[73] Assignee: Venturedyne Limited, Milwaukee, Wis.

[21] Appl. No.: 09/387,129

[22] Filed: Aug. 31, 1999

[51] Int. Cl.[7] ..... H01F 7/02

[52] U.S. Cl. ..... 335/306; 335/302; 335/291

[58] Field of Search ..... 335/302–306, 335/289–91; 252/62.62, 57, 55; 310/11

[56] References Cited

U.S. PATENT DOCUMENTS 3,784,945 1/1974 Baermann ..... 335/302
4,544,904 10/1985 Tarachand .
5,461,919 10/1995 Laughlin ..... 310/11

*Primary Examiner*—Lincoln Donovan
*Attorney, Agent, or Firm*—Jansson, Shupe, Bridge & Munger, Ltd.

[57] ABSTRACT

A composite magnet having a steel back plate on which an inner section of a first magnetic material having a high residual magnetic strength and an energy product greater than 25 million and preferably 35 million G-Oe or greater is positioned. Although possessing such high residual magnetic strength, the first magnetic material contained in the inner section comprises less than ⅛ the entire volume of the composite magnet. A barrier surrounds the inner section, and an outer section of a second magnetic material abuts the barrier and surrounds the sides of the first magnetic material. Such second section of magnetic material has a low residual magnetic strength (i.e., 3,800–4,000 G), and an energy product greater than 3 million G-Oe.

9 Claims, 3 Drawing Sheets

COMPOSITE RARE EARTH MAGNET AND METHOD FOR SEPARATING FERROUS MATERIAL FROM NON-FERROUS MATERIAL

FIELD OF THE INVENTION

This invention relates generally to magnets and, more particularly, to a magnet comprised of differing magnetic materials and a method for separating non-ferrous material from ferrous material utilizing such magnet.

BACKGROUND OF THE INVENTION

Magnets are used in a variety of ways throughout many industrial segments. In virtually all of these uses, it is advantageous to generate as much magnetic strength (i.e., pull) as possible. This creates problems in that, for the most part, the strength of a magnet is directly proportional to its size. This is because the strength of a magnet at a given distance is dependent upon its gauss and the gradient or change in gauss at that distance. In turn, the gauss of a magnet at a given distance is dependent upon the dimensions or geometry of the magnet.

Various materials are used to generate magnetic fields. These include ceramic, rare earth materials, and the materials included in electromagnets. Ceramic materials alone have a relatively low surface gauss (G) of about 1,500–2,000 G in an open circuit condition as used in an overhead surface magnet. As mentioned above, the gauss at a distance from the surface is dependent upon the dimensions of the magnet. Therefore, in order to generate a deep magnetic field, a large ceramic magnet is needed. Although ceramic magnets are relatively low in cost, it is not realistically possible to build ceramic magnets strong enough in order to generate the depth of field necessary to separate ferrous material located deep within large piles of non-ferrous material as ceramic magnets are not capable of producing a high enough gradient necessary to create the strong magnetic draw.

Unlike ceramic magnets, rare earth magnets have a relatively high surface gauss of up to 5,500 G or more in an open circuit condition. While the gauss at a distance from a rare earth magnet is also dependant upon its dimensions, it is not economically feasible to produce large rare earth magnet as such magnets are in general very expensive in that they cost about 50 times as much as a ceramic magnet of the same volume.

Although ceramic magnets are capable of producing a reasonably high gauss at a distance from the magnet's surface, because of their low surface gauss they are incapable of also producing a high gradient or change in gauss at that distance. Rare earth magnets, however, because of their high surface gauss are capable of producing both reasonably high gauss at a distance from the magnet's surface, and a high gradient. Therefore, a magnet that combined the economical features of ceramic magnets with the magnetic power of a rare earth material would be an important improvement in the art.

When large magnets exhibiting great pulling strength at a distance have been required in the past, the only economical solution has been to use electromagnets. Such magnets, however, possess several shortcomings including the fact that they require a significant amount of electric power and are very heavy. Furthermore, in many instances where the magnetic strength of electromagnets are required neither the electric power necessary for operation nor the capability of supporting the great weight of the electromagnet are available.

Composite magnets utilizing rare earth materials are known from U.S. Pat. No. 4,544,904 (Tarachand). The composite magnet disclosed in Tarachand requires an amount of rare earth material that comprises at least ⅓ of the weight of the entire magnet. Given the cost of rare earth materials, it would not be economical to produce large magnets in the manner disclosed in Tarachand. In fact, Tarachand only utilizes small sections of magnets that must be combined with other sections in order to produce a large magnetic surface area.

Given the shortcomings noted above, a permanent magnet that has great pulling strength at a distance, is economical to build, and is competitive in cost to electromagnets would be a great improvement in the art.

OBJECTS OF THE INVENTION

An object of the invention is to provide a composite magnet and a method for separating ferrous material from non-ferrous material utilizing such magnet that overcomes some of the problems and shortcomings of the prior art.

Another object of the invention is to provide a composite magnet and a new method for separating ferrous material from non-ferrous material utilizing such magnet that provides that magnetic strength of an electric magnet at a competitive cost.

Still another object of the invention is to provide a composite magnet and a method for separating ferrous material from non-ferrous material utilizing such magnet that generates the magnetic strength of a rare earth magnet at a fraction of the cost.

Yet another object of the invention is to provide a composite magnet of various geometric shapes. How these and other objects are accomplished will become apparent from the following descriptions and from the drawings.

SUMMARY OF THE INVENTION

This invention involves a composite magnet comprised of a steel back plate on which an inner section of a first magnetic material having a high residual magnetic strength and an energy product greater than 25 million and preferably 35 million G-Oe or greater is positioned. Although possessing such high residual magnetic strength, the first magnetic material contained in the inner section comprises less than ⅛ the entire volume of the composite magnet. A barrier surrounds the inner section, and an outer section of a second magnetic material abuts the barrier and surrounds the sides of the first magnetic material. Such second section of magnetic material has a low residual magnetic strength (i.e., 3,800–4,000 G), and an energy product greater than 3 million G-Oe.

Although both magnetic sections should have the same shape, e.g., circular, hexagonal, oval, the most effective configuration involves inner and outer section members which are square or rectangular. While it is preferred that the inner and outer sections of the composite magnet be of the same geometrical shape, there is no limitation in the invention that prevents the composite magnet from being comprised of two magnetic sections of differing geometrical shapes.

In a preferred embodiment of the invention, the barrier surrounding the inner section is made of stainless steel. Such barrier offsets the polarity of the two magnetic materials thereby allowing such magnetic materials to be positioned in parallel without repelling each other.

In a highly preferred embodiment of the invention, the first magnetic material located within the barrier is from the family of elements known as rare earth transition materials. In one version of such embodiment, the second magnetic material is barium ferrite oxide ($BaFe_2,O_3$).

In still another embodiment of the invention, the lengths of the sides of the outer section are greater than the lengths of the sides of the inner section. In such embodiment, a section of steel having a thickness equal to the difference in the length of the sides of the inner section and the length of the sides of the outer section is located within the barrier adjacent to the lower surface of the inner section.

In yet another embodiment of the invention, the barrier surrounds the inner section and the first magnetic material occupies no more than ⅔ of the inner section surrounded by the barrier. In such embodiment, a third material occupies the remaining area within the barrier.

Another aspect of the invention involves a method of separating ferrous material from non-ferrous material. Such method is comprised of the steps of placing a pile combined of ferrous and non-ferrous material on a conveyor belt, positioning a stationary separator magnet having an inner section of a first magnetic material of high residual magnetic strength and an energy product of 35 million G-Oe or greater surrounded on four sides by a barrier and an outer section of a second magnetic material having a low residual magnetic strength and an energy product greater than 3 million G-Oe abutting the barrier and surrounding the inner section, moving the conveyor belt under the separator magnet, magnetically drawing the ferrous material out of the pile of ferrous and non-ferrous material, and attaching the ferrous material to the separator magnet.

In other versions of such embodiment, the inner section of the first magnetic material of the composite magnet used in the method is in the shape of one of a variety of geometric shapes including a rectangle, cylindrical, hexagon, pentagon, and a square. In still other versions, the outer section of second magnetic material is in the shape of one of a variety of geometric shapes including a rectangle, cylindrical, hexagon, pentagon, and a square.

DETAILED DESCRIPTIONS OF PREFERRED EMBODIMENTS

Figure 1:
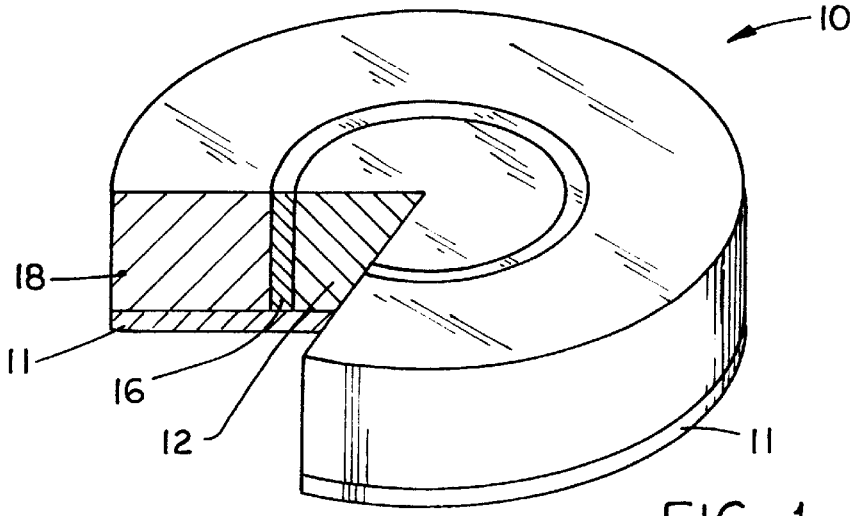
FIG. 1 is a perspective view of the composite magnet with a cut-away section showing the interior of the magnet.

FIG. 1 shows the invention that involves a hybrid or composite magnet assembly 10 which includes an inner section 12 made of a first magnetic material having a high residual magnetic strength and an energy product of 35 million G-Oe or greater positioned on a steel back plate 11. Such material is a permanently magnetized rare earth material. A barrier 16 surrounds the inner section 12, and a perimeter or outer section 18 of a second magnetic material namely a permanently magnetized ceramic material abuts the barrier 16 and surrounds the rare earth magnetic material which is received in a centered hole 22 in the outer section 18 of the second magnetic material. The second section of magnetic material has a low residual magnetic strength, and an energy product greater than 3 million G-Oe.

The two sections of magnetic material 12, 18 are aligned in parallel rather than in series. That is the two sections are positioned side by side rather than being stacked on top of each other. This results in greater overall magnetic strength.

Because the ceramic saturates at such a low level compared to the rare earth material (i.e., 4,000 G vs. 12,000 G) should the rare earth material be stacked upon the ceramic material, the ceramic would literally block the flux lines of the rare earth material thereby decreasing the overall magnetic strength. The same result occurs if the stacking order is reversed and the ceramic material is placed on top of the rare earth material. In this arrangement, the surface gauss of the ceramic material is so low that it acts like an air gap to the rare earth magnet thereby resulting in a greatly reduced overall surface gauss.

Figure 2:
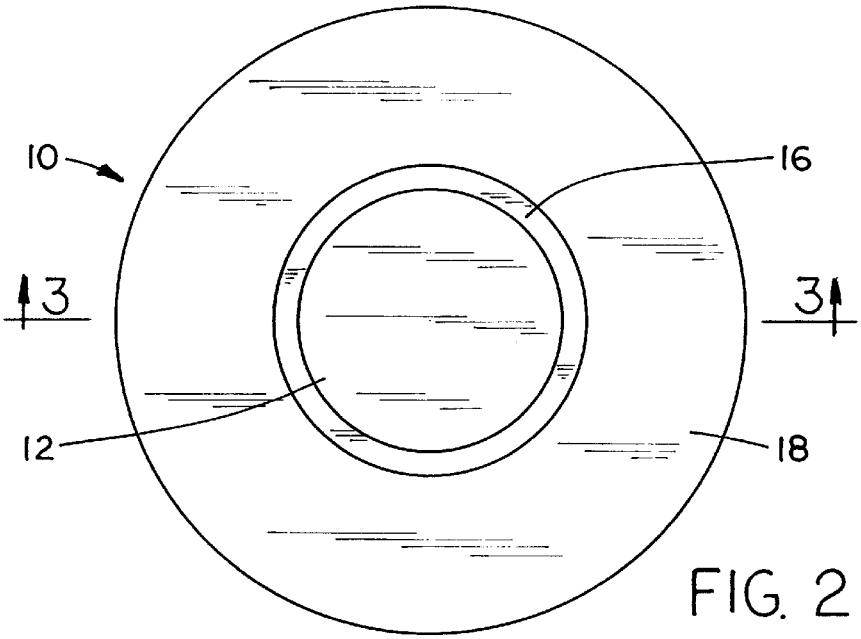
FIG. 2 is a top view of the composite magnet.
Figure 3:
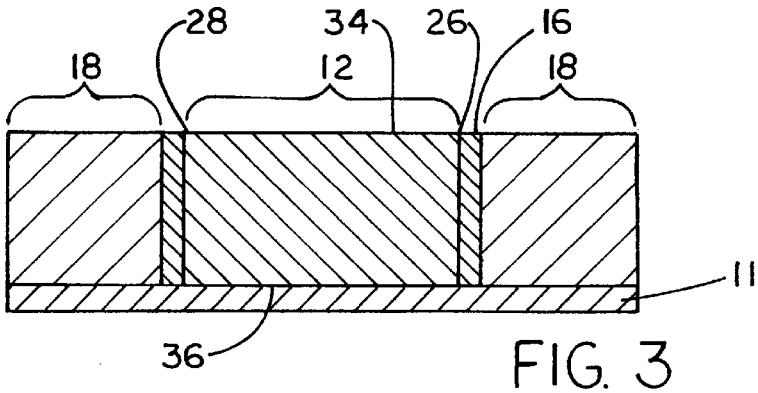
FIG. 3 is a section taken through the composite magnet on the line 3—3 of FIG. 2.
Figure 4:
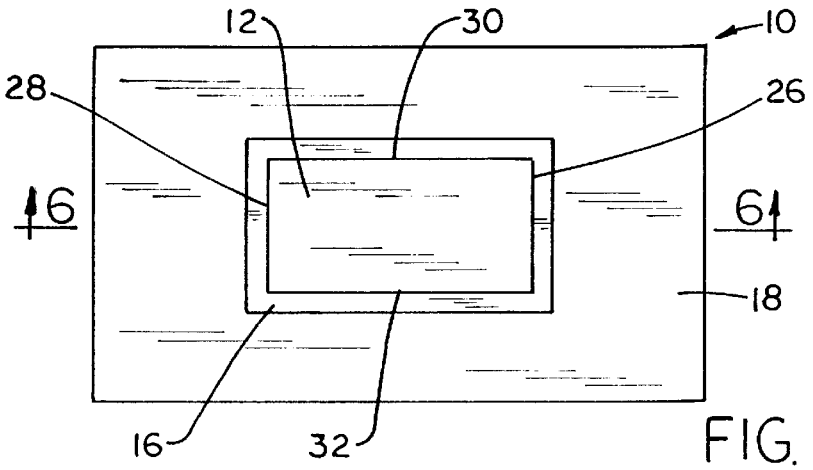
FIG. 4 is a top view of the composite magnet having a rectangular shaped inner and outer section.

Although possessing high residual magnetic strength, the inner section 12 of first magnetic material comprises less than ⅛ the entire volume of the composite magnet 10. In a preferred embodiment of the invention, as shown in FIG. 2, the composite magnet 10 includes a single outer section member 18 and a single inner section member 12. Although both members should have the same shape, e.g., circular, hexagonal, oval, the most efficient and effective configuration involves inner and outer section members 12, 18 which are square or rectangular as shown in FIG. 4. In such embodiment, as shown in FIGS. 3 and 4, the inner section 12 of the magnet 10 has substantially parallel first and second sides 26, 28 , a third and fourth side 30,32 substantially parallel to each other and perpendicular to the first 26 and second side 28, and an upper 34 and lower surface 36 substantially parallel to each other and perpendicular to the first four sides 26–32.

Figure 5:
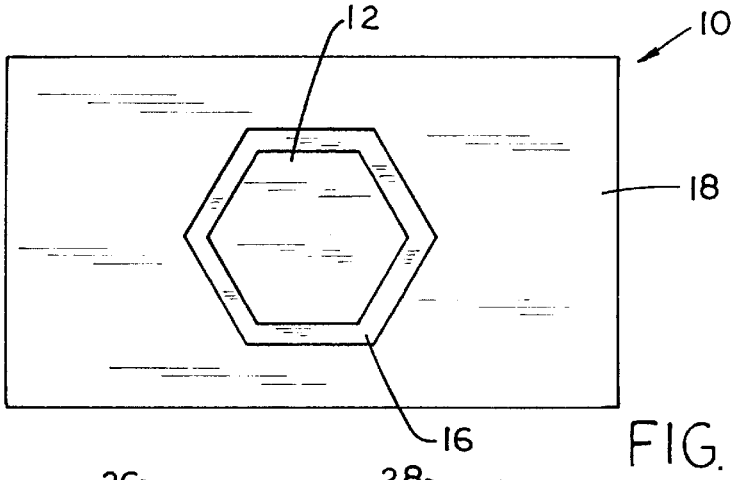
FIG. 5 is a top view of the composite magnet showing an inner and outer section of differing geometrical shapes.

In a specific version of the preferred embodiment, i.e., a separator magnet, the dimensions of the outer section 18 are 36"×36"×5" or 33"×33"×6" and the dimensions of the inner member 12 are 12"×12"×5"or 11"×11"×6", respectively. While it is preferred that the inner and outer sections 12, 18 of the composite magnet be of the same geometric shape, as shown in FIGS. 2 and 4, there is no limitation in the invention that prevents the composite magnet 10 from being comprised of two magnetic sections of differing geometrical shapes, as shown in FIG. 5.

Given the respective densities of the various magnetic materials, it can be seen that the rare earth component comprises no more than approximately ⅐ the weight of the composite magnet. This invention is based in part on the discovery that it is possible to produce an effective composite magnet using less rare earth material than was previously thought possible.

In still another embodiment of the invention, the barrier 16 surrounding the inner section 12 is made of stainless steel. Such barrier is necessary to offset the polarity of the two magnetic materials thereby allowing such magnetic materials to be positioned in parallel without repelling each other.

In a highly preferred embodiment of the invention, the first magnetic material located within the barrier 16 is from the family of elements known as rare earth transition materials. In a specific version of such embodiment, the second magnetic material is barium ferrite oxide ($BaFe_2O_3$).

Figure 6:
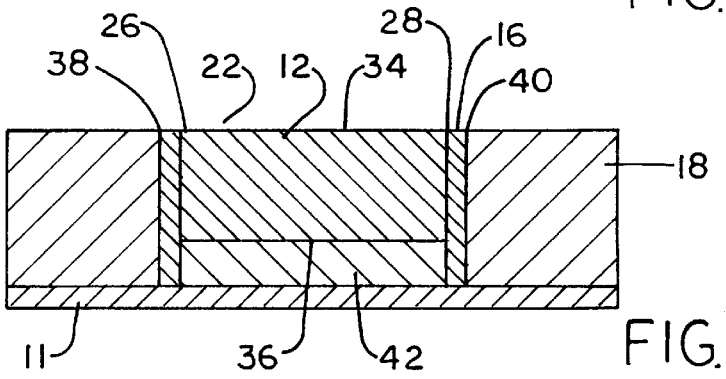
FIG. 6 is a section taken through the composite magnet on the line 6—6 of FIG. 4. Such section shows a second magnetic material having greater depth than the first magnetic material in the inner section.

FIG. 6 shows still another embodiment of the invention in which the depths of the sides 38,40 of the outer section 18 are greater than the depths of the sides 26,28 of the inner section 12. In such embodiment, a section of steel 42 having a thickness equal to the difference in the depth of the sides 26,28 of the inner section 12 and the depth of the sides 38,40 of the outer section 18 is located within the barrier 16 adjacent to the lower surface 36 of the inner section 12.

Figure 7:
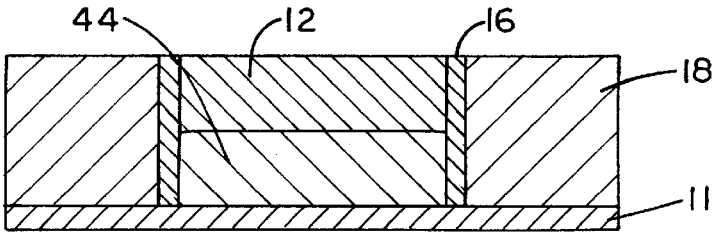
FIG. 7 is a section taken through the composite magnet on line 6—6 of FIG. 4 showing a first magnetic material occupying less than ⅔ of the inner section of the magnet.

In yet another embodiment of the invention, as shown in FIG. 7, the barrier 16 surrounds the inner section 12 and the first magnetic material occupies no more than ⅔ of the inner section. In such embodiment, a third material 44 occupies the remaining area within the barrier 16.

Figure 8:
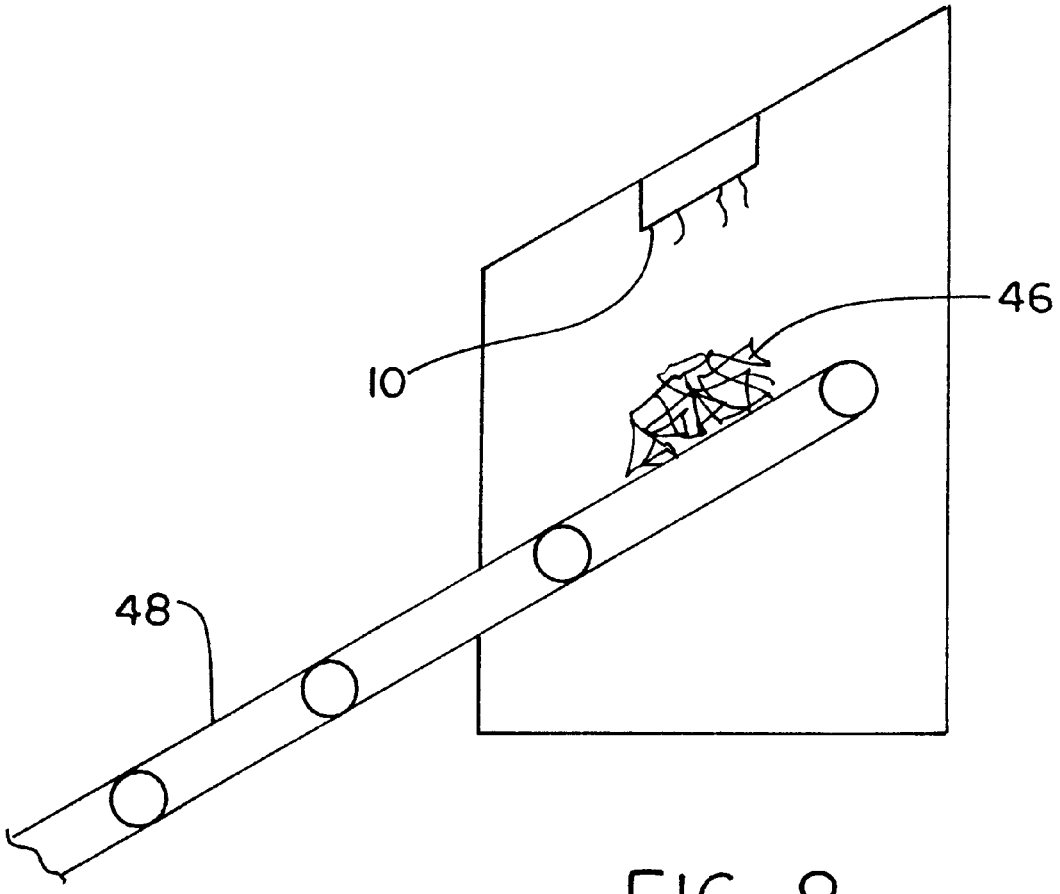
FIG. 8 is a sectional schematic view of a conveyor system transporting a pile of scrap under the composite magnet.

FIG. 8 shows another aspect of the invention which involves a method of separating ferrous material from non-ferrous material. Such method is comprised of the steps of placing a pile 46 of combined ferrous and non-ferrous material on a conveyor belt 48, positioning a stationary separator magnet 10 having an inner section 12 of a first magnetic material of high residual magnetic strength and an energy product of 35 million G-Oe or greater surrounded by a barrier 16 and an outer section 18 of a second magnetic material having a low residual magnetic strength and an energy product greater than 3 million G-Oe abutting the barrier 16 and surrounding the inner section 12 over the conveyor 48, moving the conveyor belt 48 under the separator magnet 10, magnetically drawing the ferrous material out of the pile 46, and attaching the ferrous material to the separator magnet 10.

The claimed method is useful for sorting materials such as commingled recyclables at material recovery facilities to obtain separate material streams, presorted recyclables at intermediate processing facilities to ensure high quality materials, refuse at mixed waste processing facilities to recover recyclable ferrous materials, organic materials at composting locations, and shredded tires at tire recycling processing sites.

In a preferred embodiment of the method, both the inner section 12 of first magnetic material and the outer section 18 are of the same geometric shape. While it is preferred that such geometric shape be either square or rectangular, there is no limitation in the invention that prevents the composite magnet from being comprised of two magnetic sections of differing geometrical shapes.

While the principles of the invention have been shown and described in connection with but a few embodiments, it is to be understood clearly that such embodiments are by way of example and are not limiting.

What is claimed:

1. A composite magnet including inner and outer magnetic sections, comprising:

a steel back plate;

the inner section having a first magnetic material of high residual magnetic strength and an energy product greater than 25 million G-Oe, said first magnetic material comprising less than ⅛ the volume of the composite magnet;

a barrier positioned on the steel back plate surrounding the inner section; and the outer section having a second magnetic material positioned on the steel back plate, said second magnetic material abutting the barrier and surrounding the first magnetic material, said second section of magnetic material having a low residual magnetic strength, and an energy product greater than 3 million G-Oe.

2. The composite magnet of claim 1 wherein the first section is in the form of various geometrical shapes including a cylinder, a pentagon, a hexagon and the like.

3. The composite magnet of claim 2 wherein the second section is in the form of one of a variety of geometrical shapes including a cylinder, a pentagon, a hexagon and the like.

4. The composite magnet of claim 1 wherein the second section is in the form of one of a variety of geometrical shapes including a cylinder, a pentagon, a hexagon and the like.

5. The composite magnet of claim 1 wherein the barrier is made of stainless steel.

6. The composite magnet of claim 1 wherein the first magnetic material is from the family of elements known as rare earth transition materials.

7. The composite magnet of claim 6 wherein the second magnetic material is barium ferrite oxide ($BaFe_2O_3$).

8. The composite magnet of claim 1 wherein:

the lengths of the sides of the outer section are greater than the lengths of the sides of the inner section; and a section of steel having a thickness equal to the difference in the length of the sides of the inner section and the length of the sides of the outer section is located within the barrier adjacent to the lower surface of the inner section.

9. The composite magnet of claim 1 wherein:

the barrier surrounds the inner section;

the first magnetic material occupies no more than ⅔ of the inner section surrounded by the barrier; and a third material occupying the remaining area within the barrier.

* * * * *